US007828277B2

(12) United States Patent
Kayahara et al.

(10) Patent No.: US 7,828,277 B2
(45) Date of Patent: Nov. 9, 2010

(54) SHEET STORING DEVICE STORING SHEETS UPRIGHT, POST-PROCESSING APPARATUS EQUIPPED WITH THE DEVICE AND IMAGE FORMING SYSTEM EQUIPPED WITH THE APPARATUS

(75) Inventors: Hirofumi Kayahara, Hachioji (JP); Toshio Shida, Higashiyamato (JP); Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 119 days.

(21) Appl. No.: 11/900,250

(22) Filed: Sep. 11, 2007

(65) Prior Publication Data

US 2008/0106024 A1 May 8, 2008

(30) Foreign Application Priority Data

Nov. 2, 2006 (JP) ..... 2006-298685

(51) Int. Cl.
*B41L 43/00* (2006.01)
*B41L 43/12* (2006.01)
*B65G 33/04* (2006.01)
*B65G 39/00* (2006.01)

(52) U.S. Cl. ..... 270/58.12; 270/58.07; 270/58.11; 270/58.27; 270/58.08; 270/58.09

(58) Field of Classification Search ..... 270/32, 270/37, 58.07, 58.08, 58.09, 58.11, 58.12
See application file for complete search history.

(56) References Cited

U.S. PATENT DOCUMENTS 3,814,415 A 6/1974 Hunter et al.
4,019,730 A 4/1977 Staudinger et al.
4,958,820 A * 9/1990 Johdai et al. ..... 270/58.27
5,104,109 A 4/1992 Kubo
6,076,825 A 6/2000 Kato et al.
6,161,830 A 12/2000 Yap
6,220,592 B1 * 4/2001 Watanabe et al. ..... 271/241
6,776,407 B2 8/2004 Lindenmayer et al.

(Continued)

FOREIGN PATENT DOCUMENTS

JP 54-118067 A 9/1979

(Continued)

OTHER PUBLICATIONS

Notice of Allowance dated Nov. 19, 2009 issued in related U.S. Appl. No. 11/900,074.

(Continued)

*Primary Examiner*—Gene Crawford
*Assistant Examiner*—Yolanda Cumbess
(74) *Attorney, Agent, or Firm*—Holtz, Holtz, Goodman & Chick, PC

(57) ABSTRACT

A sheet storing device that has a conveyance device that holds a folded sheet to convey and a sheet storing section on which a sheet falling after being released from holding is placed, and allows a position of holding lower end position of the aforesaid conveyance device to be variable, a post-processing apparatus equipped with the sheet storing device and an image forming system equipped with the aforesaid items.

16 Claims, 8 Drawing Sheets

U.S. PATENT DOCUMENTS

| | | | | |
|---|---|---|---|---|
| 6,877,739 | B2 | 4/2005 | Leitz et al. | |
| 6,889,973 | B2 | 5/2005 | Gammerler et al. | |
| 2002/0140160 | A1 | 10/2002 | Gammerler et al. | |
| 2003/0234485 | A1 | 12/2003 | Gosslinghoff | |
| 2004/0262832 | A1 * | 12/2004 | Kaneko | 270/58.08 |
| 2005/0189704 | A1 | 9/2005 | Oexle et al. | |
| 2008/0106029 | A1 | 5/2008 | Shida et al. | |

FOREIGN PATENT DOCUMENTS

| | | | | |
|---|---|---|---|---|
| JP | 3-120127 | A | | 5/1991 |
| JP | 4-028663 | A | | 1/1992 |
| JP | 4-028664 | A | | 1/1992 |
| JP | 04028663 | A | * | 1/1992 |
| JP | 07-033309 | A | | 2/1995 |
| JP | 07033309 | A | * | 2/1995 |
| JP | 07-112860 | A | | 5/1995 |
| JP | 11-35211 | A | | 2/1999 |
| JP | 11035211 | A | * | 2/1999 |

OTHER PUBLICATIONS

U.S. Appl. No. 11/900,074, entitled: "Sheet Storing Device, Post-Processing Apparatus Equipped With the Device and Image Forming System Equipped With the Apparatus," Inventor: Shida et al, filed Sep. 10, 2007.

Japanese Office Action mailed Oct. 7, 2008 and English translation thereof issued in a counterpart Japanese Application No. 2006-298684 of related U.S. Appl. No. 11/900,074.

Japanese Office Action dated Dec. 15, 2009 and English translation thereof issued in a counterpart Japanese Application No. 2007-283112.

* cited by examiner

SHEET STORING DEVICE STORING SHEETS UPRIGHT, POST-PROCESSING APPARATUS EQUIPPED WITH THE DEVICE AND IMAGE FORMING SYSTEM EQUIPPED WITH THE APPARATUS

This application is based on Japanese Patent Application No. 2006-298685 filed on Nov. 2, 2006 in Japanese Patent Office, the entire content of which is hereby incorporated by reference.

BACKGROUND OF THE INVENTION

The present invention relates to a sheet storing device that stores a large number of sheets, a post-processing apparatus equipped with the sheet storing device and an image forming system equipped therewith, and in particular, to a sheet storing device that stores folded sheets.

A folded sheet takes a condition that plural sheets are superposed by folding operations to take an irregular shape by swelling.

Conventionally, in the post-processing apparatus connected to an image forming apparatus, sheets folded and ejected have been stored in a box-shaped storing device under the irregular condition.

Therefore, there have been problems including that a capacity of the storing device runs short and that the ejected sheets scatter.

In Patent Document 1, there is disclosed a sheet storing device that aligns folded sheets to store them.

In the sheet storing device disclosed by Patent Document 1, sheets fed into the sheet storing device continuously are stopped temporarily by a stopping roller to avoid a lift of the sheet, and then the sheet is conveyed to a sheet storing section.

Patent Document 1 discloses two types of sheet storing devices, and in the first one of them, a succeeding sheet is inserted to be under a preceding sheet, whereby, a sheet is inserted into the bottom of sheets in the sheet storing section, thus, the sheets are stacked vertically in the lying situation in the sheet storing section. In the second one of them, a succeeding sheet is supplied to the upper side of a preceding sheet, and sheets are stacked to be inclined at the storing section.

Width H of the folded sheet which is a length of the sheet in the direction perpendicular to sheet edge E formed by a fold as shown in FIG. 1 varies depending on a sheet size and on a type of folding processing.

The folded sheet is usually conveyed with its sheet edge E formed by a fold being perpendicular to the sheet conveyance direction. The conveyance method of this kind is also employed even in Patent Document 1, and in the Patent Document 1, the succeeding sheet is superposed under or over the preceding sheet, so that a large number of sheets are superposed in the prescribed order to be stored.

When width H of the folded sheet is changed as stated above, there is a problem that sheets are not superposed under the correct order and they are not aligned, when superposing preceding sheet and succeeding sheet one after another.

[Patent Document 1] Unexamined Japanese Patent Application Publication No. 11-35211

SUMMARY

Aspects of the present inventions are follows.

1. A sheet storing device having a conveyance device that holds a sheet and conveys it and a storing section that stores a sheet conveyed by the conveyance device, in which the holding by the conveyance device is released and the sheet is dropped to be stored in the storing section, wherein a distance from the storing section to the position of lower end for holding by the conveyance device is variable.

2. A post-processing unit having a post-processing apparatus for folding a sheet, and the above sheet storing device for conveying and storing the sheet folded by the post-processing apparatus.

3. An image forming system having therein an image forming apparatus that forms an image on a sheet, a post-processing apparatus that folds the sheet ejected from the image forming apparatus and the aforesaid sheet storing device that conveys and stores the sheet folded by the post-processing apparatus.

DETAILED DESCRIPTION OF THE PREFERRED EMBODIMENT

The invention will be described as follows, referring to the following embodiment, to which, however, the invention is not limited.

<Image Forming System>

Figure 1:
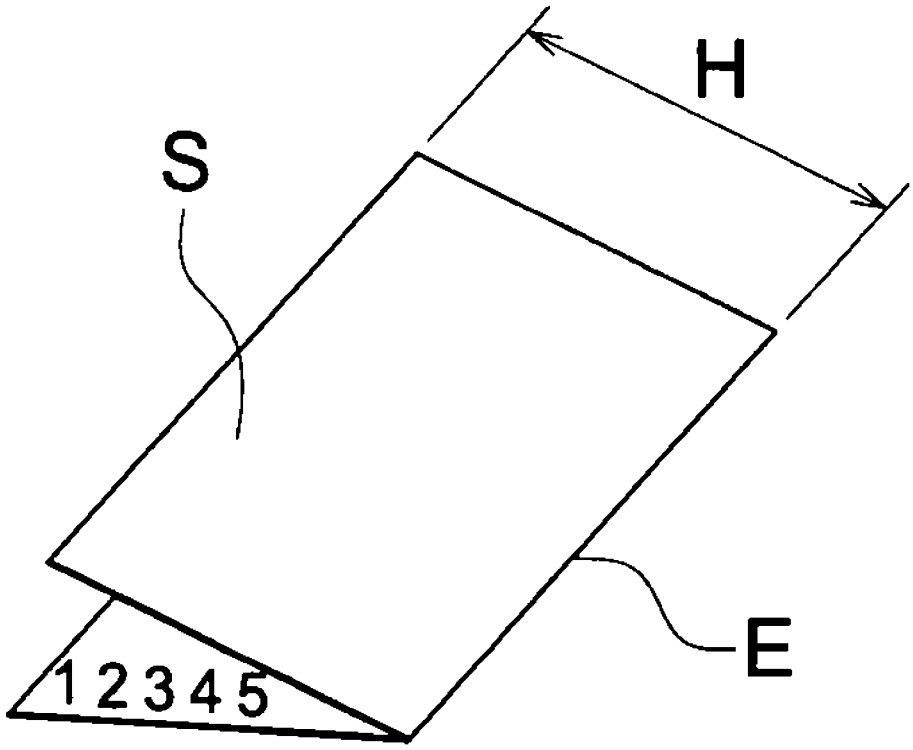
FIG. 1 is a diagram showing a width of the folded sheet.
Figure 2:
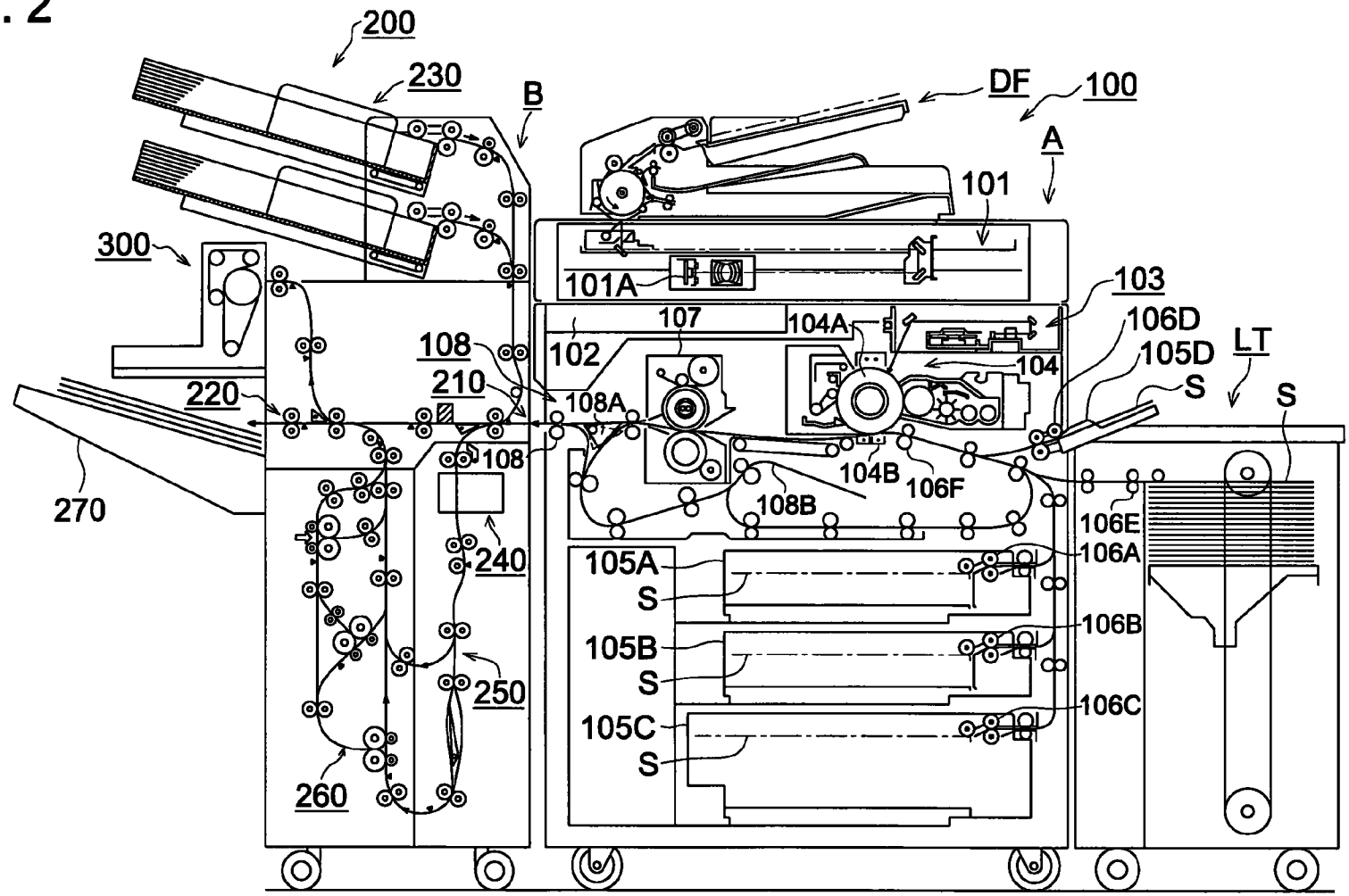
FIG. 2 is an overall structural diagram of an image forming system relating to an embodiment of the invention.

FIG. 2 is an overall structural diagram of an image forming system equipped with image forming apparatus 100, post-processing apparatus 200 having a folding device and sheet storing device 300.

Illustrated image forming apparatus 100 is equipped with automatic document feeder DF, image reading section (image input device) 101, image processing section 102, image writing section 103, image forming section 104, sheet feeding cassettes 105A, 105B and 105C, manual sheet feeding tray 105D, first sheet feeding sections 106A, 106B, 106C and 106D, second sheet feeding section 106F, fixing unit 107, sheet ejection section 108, automatic double-sided copy sheet feeding unit (ADU) 108B and with large capacity sheet feeding unit LT.

A document placed on a document table of automatic document feeder DF is conveyed, images on a single side or both sides of the document are read by an optical system of image reading section 101, and are read in by image sensor 101A.

Analog signals subjected to photoelectric conversion by image sensor 101A are subjected to analog processing, A/D conversion, shading correction and image compression processing in image processing section 102, and signals are sent to image writing section 103.

In the image writing section 103, light outputted from a semiconductor laser is projected on photoconductor drum 104A of image forming section 104 to form a latent image. In the image forming section 104, processes such as charging, exposure, developing, transfer, separation and cleaning are conducted. Images are transferred by transfer device 104B onto sheet S supplied by respective first sheet feeding sections 106A-106E from sheet feeding cassettes 105A-105C, manual sheet feeding tray 105D and large capacity sheet feeding unit LT. The sheet S carrying images is subjected to fixing processing by fixing unit 107 to be fed into post-processing apparatus 200 from sheet ejection section 108. Or, sheet S which has been finished on its one side in terms of image processing and has been fed into automatic double-sided copy sheet feeding unit 108B from conveyance path switching plate 108A is ejected from sheet ejection section 108 after being subjected to image processing on both sides in image forming section 104 again.

<Post-processing Apparatus>

Post-processing apparatus 200 is composed of post-processing apparatus carry-in section 210, post-processing apparatus ejection section 220, sheet adding section (feeding section of sheet for cover) 230, hole-punching processing section (punching processing section, first processing section) 240, conveyance section 250, folding processor 260 and elevating sheet ejection section 270.

Figure 3:
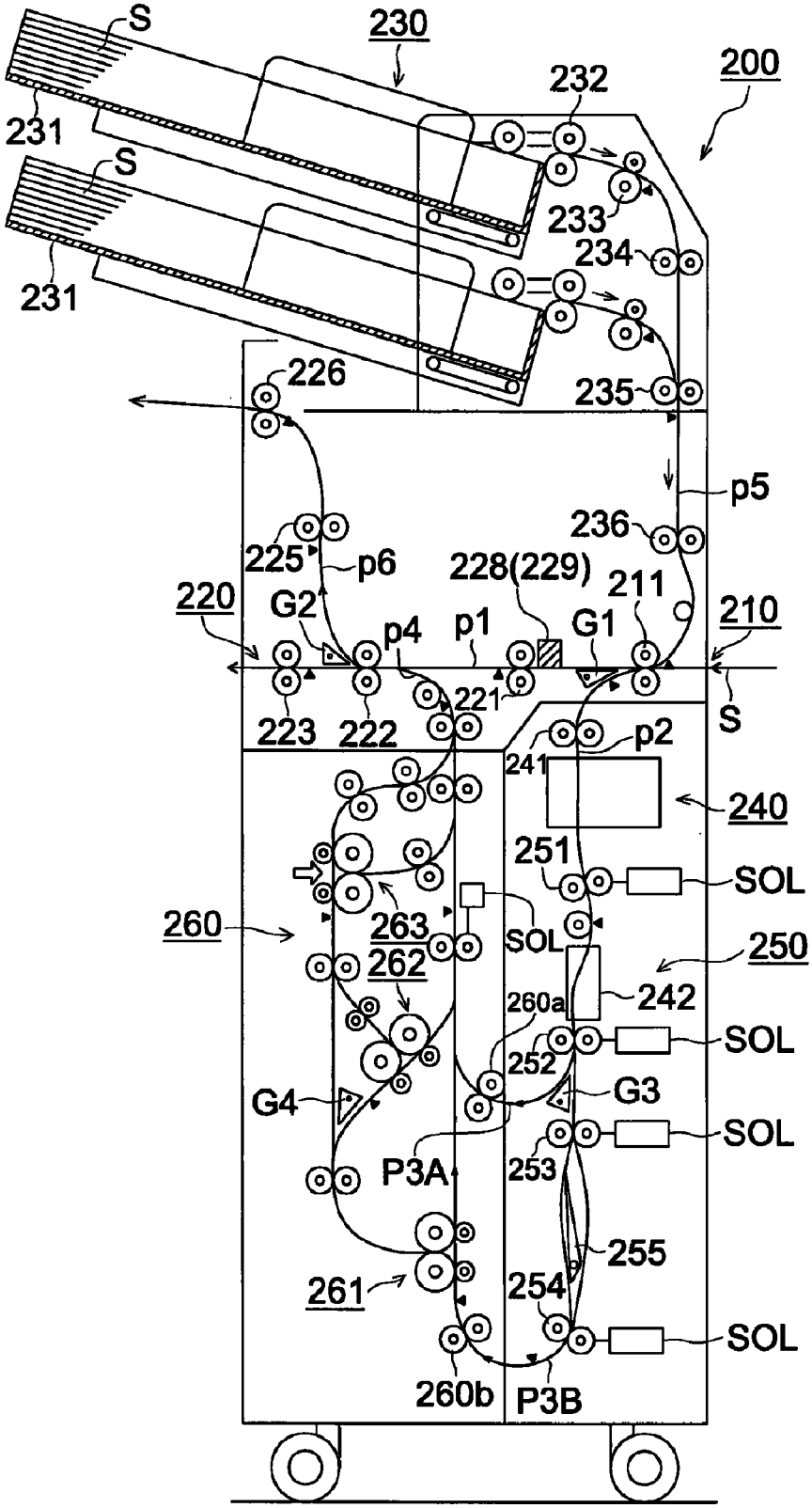
FIG. 3 is an overall structural diagram of a post-processing apparatus.

FIG. 3 is an overall structural diagram of post-processing apparatus 200.

Sheet S which has been subjected to image forming is introduced into the post-processing apparatus carry-in section 210 from image forming apparatus 100.

A sheet introduction position of the post-processing apparatus carry-in section 210 faces a sheet ejection position of sheet ejection section 108 of image forming apparatus 100.

Sheet S introduced to entrance roller 211 is branched by conveyance path switching device G1 to either one of post-processing apparatus ejection section 220 and hole-punching processing section 240.

When neither punching processing nor folding processing is set, conveyance path switching device G1 closes a conveyance path to hole-punching processing section 240, and opens a conveyance path to the post-processing apparatus ejection section 220.

Sheet S passing through first conveyance path p1 leading to the post-processing apparatus ejection section 220 is pinched by conveyance rollers 221 and 222 to advance straight, and further is guided by conveyance path switching device G2 to advance straight, and is ejected by sheet ejection roller 223 to elevating sheet ejection section 270. The elevating sheet ejection section 270 has a elevating tray that lowers depending on an amount of stacked sheets, and thereby, a large number of sheets S can be stacked.

A sheet for a cover or sheet S for insertion stored in sheet feeding tray 231 of sheet adding section 230 is separated and fed by sheet feeding device 232, and is pinched by conveyance rollers 233, 234, 235 and 236 of fifth conveyance path p5, to be conveyed to the conveyance path on the upstream side of a branched portion.

The sheet feeding trays 231 of sheet adding section 230 are arranged on two steps as an upper step and a lower step, and each sheet feeding tray 231 can accept the maximum of 500 sheets as a capacity for covers or sheets S for insertion.

It is also possible to load sheets S on sheet adding section 230, and to conduct hole-punching processing or folding processing on sheets S without conducting image recording.

Sheet S branched by conveyance path switching device G1 of post-processing apparatus carry-in section 210 is pinched by conveyance roller 241 arranged under the conveyance path switching device G1, and is conveyed to hole-punching processing section (first processing section) 240 (second conveyance path p2).

On the conveyance path on the downstream side of the hole-punching processing section 240, there is arranged alignment device 242 which aligns a lateral direction of sheet S before hole-punching processing.

A puncher of the hole-punching processing section 240 is composed of a punch that is driven by an unillustrated driving device and of a die that engages with a blade portion of the punch. The sheet S which has been subjected to hole-punching processing is sent to lower conveyance section 250.

The sheet S sent to the lower conveyance section 250 is pinched by conveyance rollers 251, 252, 253 and 254 to be conveyed to folding processor 260. The conveyance rollers 251, 252, 253 and 254 are composed of driving rollers connected to a driving source and of driven rollers which are in pressure contact with the driving rollers. Each driven roller is connected to solenoid SOL to be capable of being in contact with or separated from the driving roller.

The sheet S which is not to be folded among small-sized sheets S subjected to hole-punching processing passes through third-A conveyance path P3A that is branched from conveyance path switching device G3, and is pinched by conveyance roller 260*a* to be conveyed. Large-sized sheet S which has been subjected to hole-punching processing is conveyed to third-B conveyance path P3B under the branching position of conveyance path switching device G3 independently of necessity of folding processing, then, is conveyed by conveyance rollers 253 and 254 to be introduced to folding processor 260. In this case, the third conveyance path is composed of third-A conveyance path P3A and third-B conveyance path P3B.

When conveyance path switching device 255 is provided on conveyance section 250 and two small-sized sheets S are accumulated to be conveyed, two sheets can be folded simultaneously.

Figure 4:
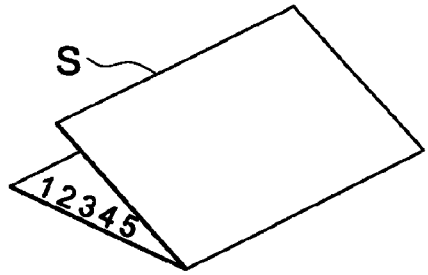
FIGS. 4(*a*), 4(*b*), 4(*c*), 4(*d*) are diagrams showing sheets folded in various forms.
Figure 4:
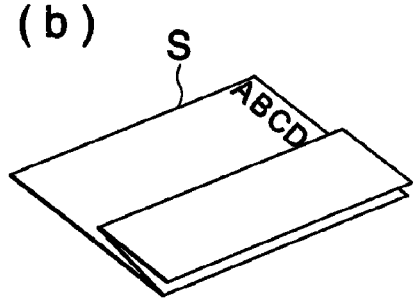
Figure 4:
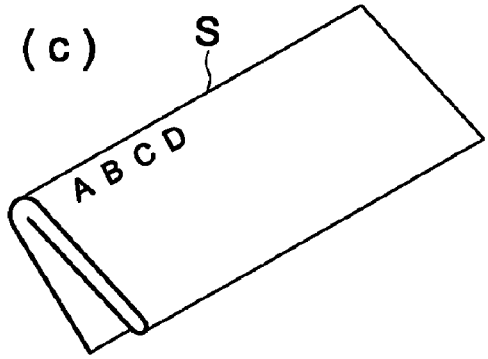
Figure 4:
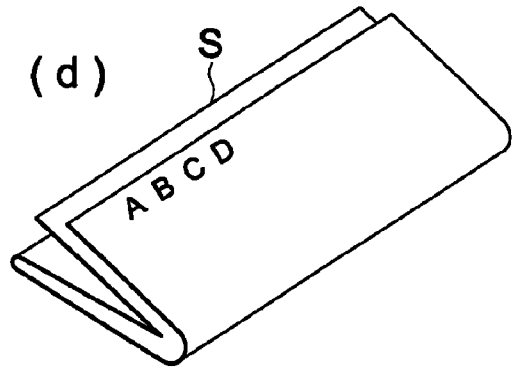

Sheet S conveyed to the folding processor 260 from conveyance section 250 is pinched by registration roller 260*b* to be conveyed and then, is subjected to various types of folding processes such as center-folding (FIG. 4 (*a*)), Z-folding (FIG. 4 (*b*)), three-folding (FIG. 4 (*c*)) and double-parallel folding (FIG. 4 (*d*)) in first folding section 261, second folding section 262 and third folding section 263, and returns to the first conveyance path p1 through fourth conveyance path p4.

The sheet S which has been subjected to folding processing is guided upward by conveyance path switching device G2, and is conveyed by conveyance roller 225 and sheet ejection roller 226 to be ejected to sheet storing device 300.

<Sheet Storing Device>

Figure 5:
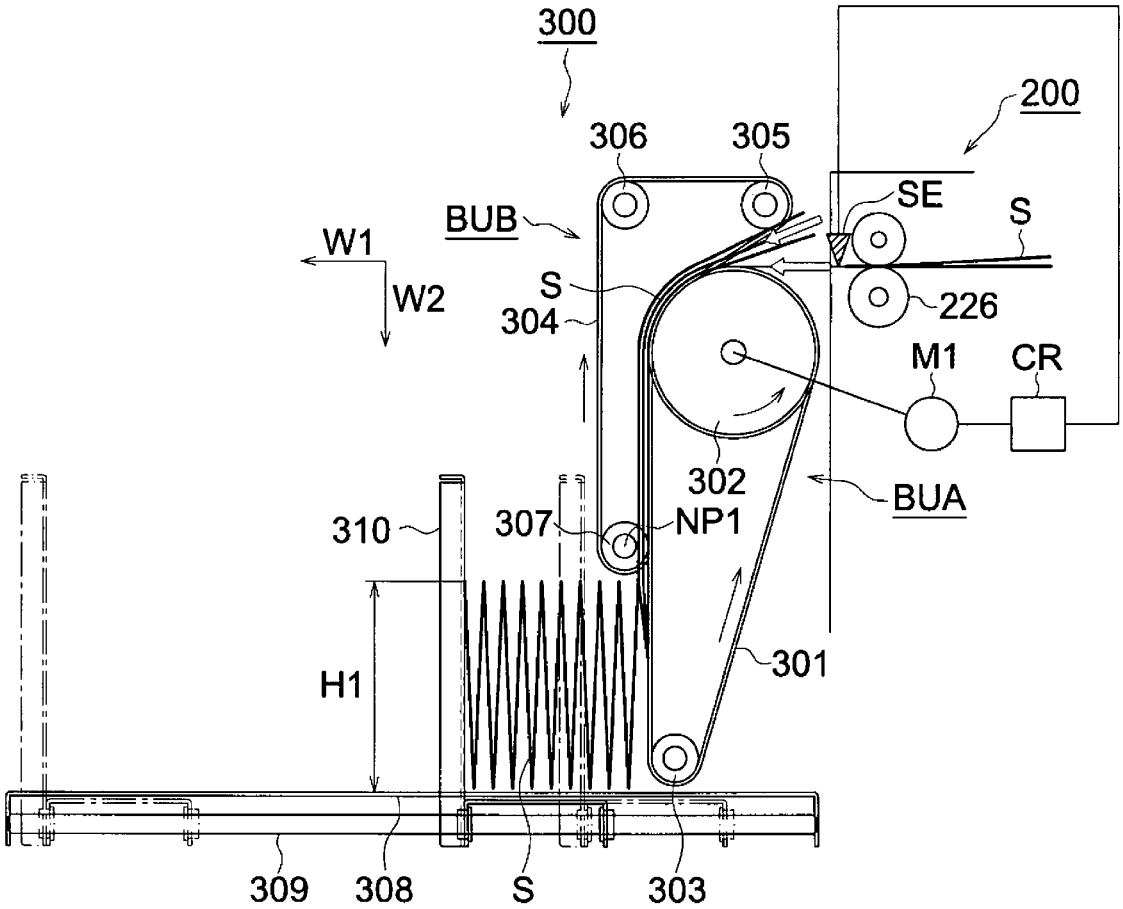
FIG. 5 is a front sectional view of a sheet storing device relating to an embodiment of the invention.
Figure 6:
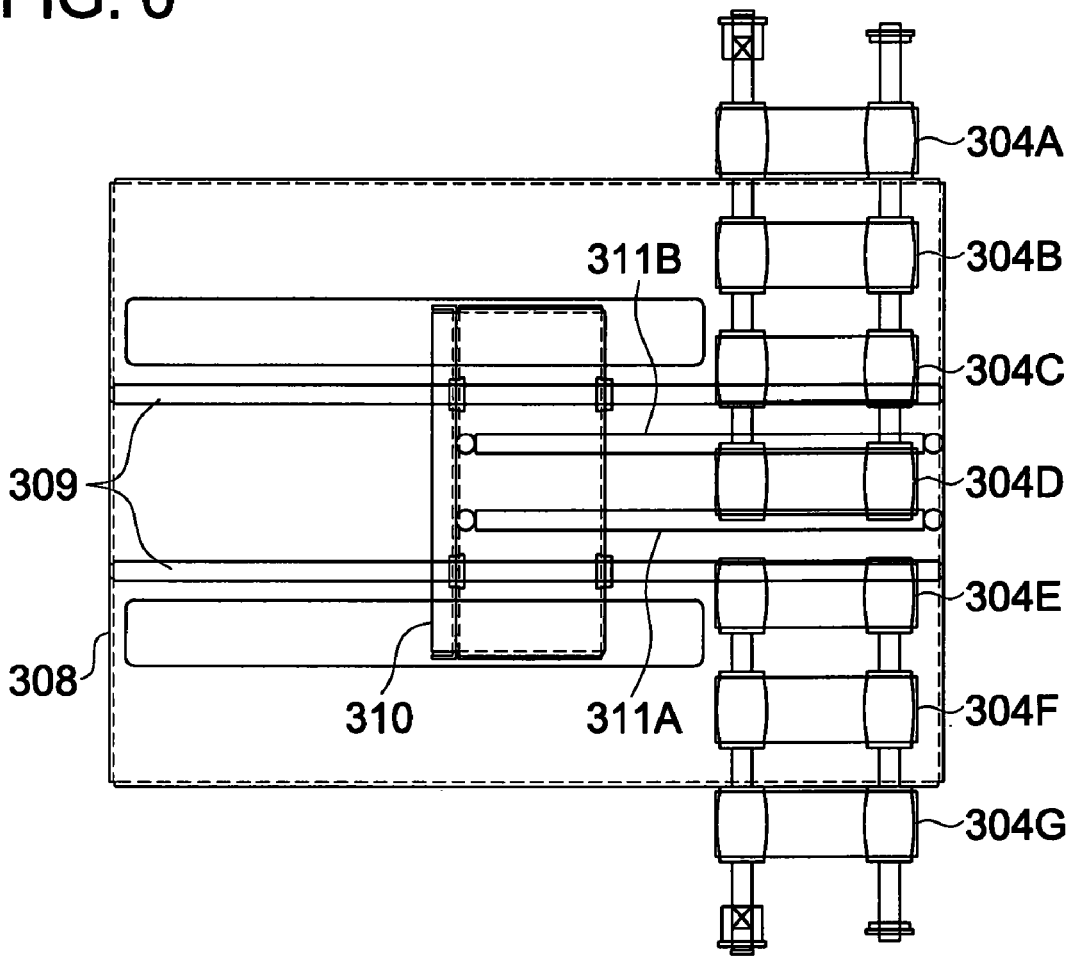
FIG. 6 is a top view of a sheet storing device relating to the embodiment of the invention.

FIG. 5 is a front sectional view of a sheet storing device and FIG. 6 is a top view of a sheet storing device.

The sheet storing device 300 is composed of first belt unit BUA and second belt unit BUB constituting a conveyance device that converts the conveyance direction for sheet S fed into the sheet storing device 300 after folding processing from the horizontal direction to the substantial vertical direction and a storing section having loading table 308 on which sheet S is placed and pressing plate 310 representing a pressing member which are main structural elements.

The first belt unit BUA has therein belt 301 that is composed of a rubber belt, large-diameter roller 302 and small-diameter roller 303. The belt 301 is stretched between the large-diameter roller 302 and the small-diameter roller 303, to revolve (rotate) as shown by an arrow.

The second belt unit BUB has therein belt 304 that is composed of a rubber belt and three small-diameter rollers 305-307. The belt 304 is stretched between the small-diameter rollers 305-307, to rotate as shown by an arrow.

As shown in FIG. 6, the belt 304 is composed of plural belts 304A-304G arranged in parallel in the lateral direction of sheet S. Though FIG. 6 shows only plural belts 304A-304G, belt 301 is also in the same manner, and it is composed of plural belts arranged in parallel in the lateral direction of the sheet.

As illustrated, in the first belt unit BUA, a conveyance surface in the horizontal direction is formed by a portion of belt 301 on a summit portion of large-diameter roller 302, and a conveyance surface in the substantial vertical direction is formed by a left side portion of belt 301 moving downward in the figure.

Belt 304 is in pressure contact with belt 301 along the large-diameter roller 302, and a conveyance direction shown with W1 which is substantially horizontal and a conveyance direction shown with W2 which is substantially vertical are formed, thus, sheet S is held between belt 301 and belt 304 to be conveyed in the direction shown with W1 and then, is conveyed in the direction shown with W2 after a change of direction.

Loading table 308 forms a table surface representing the second supporting surface which is substantially horizontal, and guide bar 309 is provided to be in parallel with the loading table 308, whereby, pressing plate 310 that presses sheet S is guided by the guide bar 309 to move in the horizontal direction, while being urged by springs 311A and 311B and thereby pressing lightly sheet S on the loading table 308. Each of the springs 311A and 311B is a fixed-load spring, and the pressing plate 310 presses sheet S with pressure that is substantially constant, independently of its position accordingly.

When the large-diameter roller 302 is driven by motor M1, each of the belts 301 and 304 is rotated as shown with an arrow.

Sheets S are ejected continuously from post-processing apparatus 200 to be detected by sensor SE provided on a sheet ejection section of the post-processing apparatus 200.

Under the situation where sheets S are continuously fed to sheet storing device 300 from post-processing apparatus 200, controller CR starts motor M1 based on signals of sensor SE that has detected a leading edge of the foremost sheet S among consecutive numerous sheets S, to drive the large-diameter roller 302 for rotation.

The large-diameter roller 302 is accelerated in terms of speed from a resting state, and then, arrives at the conveyance speed that is the same as that of sheet ejection roller 226. After that, it starts to convey sheets at a constant conveyance speed. Then, when the sensor SE detects the trailing edge of the preceding sheet S, the controller CR stops the drive of motor M1 temporarily based on the detection signal. Further, based on the detection signal due to detection of the leading edge of the succeeding sheet S2 by the sensor SE, the controller CR restarts the drive of motor M1 to start the conveyance of the preceding sheet S1 which has been stopped temporarily. The large-diameter roller 302 is accelerated from the temporary stop state and after the conveyance speed of the large-diameter roller 302 reaches that of sheet ejection roller 226, the succeeding sheet S2 arrives at the nip portion of belts 301 and 304 and is conveyed at a constant conveyance speed.

Figure 7:
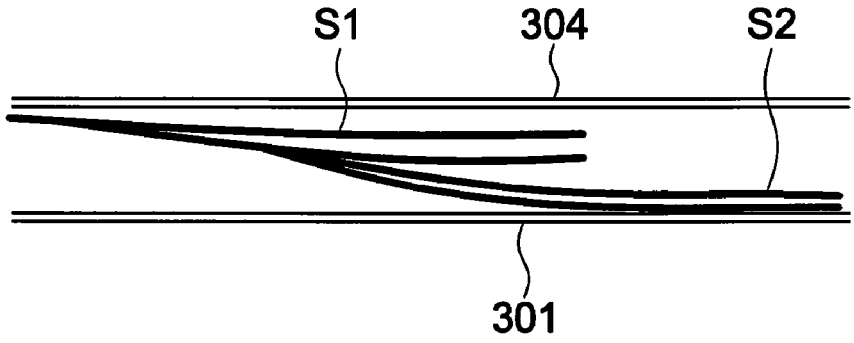
FIG. 7 is a diagram showing how superposed sheets are conveyed.

There is generated a difference between a conveyance distance of sheet ejection roller 226 that conveys at a constant speed and a conveyance distance of the large-diameter roller 302 (belt 301 and belt 304) that is accelerated in terms of a speed from a resting state to the constant speed for conveying. This difference causes a trailing edge of preceding sheet S1 and a leading edge of succeeding sheet S2 to be overlapped during continuous conveyance so that plural sheets, preceding sheet S1 and succeeding sheet S2 are held to be overlapped between belt 301 and belt 304, as shown in FIG. 7.

The sheet S thus fed in is held between belt 301 and belt 304 to be changed in terms of a direction from direction W1 to direction W2, and is conveyed downward substantially vertically. After that, the same control is applied to a number of sheets S continuously fed from post-processing apparatus 200 to sheet storing device 300.

Small-diameter roller 307 forms a lower end position of holding of sheet S to be arranged so that holding lower end position NP1 may be slightly higher than width H1 of folded sheet S, and there is constructed so that the sheet S released from holding by belt 301 and belt 304 may fall on loading table 308. Incidentally, the holding lower end position NP1 is at the position that is the same as a rotation center of the small-diameter roller 307 in terms of a height.

As illustrated, plural sheets S are stored on loading table 308 to be substantially perpendicular to the loading table 308. The stacked sheets S are supported by belt 301 representing the first supporting member so that a sheet surface is substantially perpendicular, and a lower end edge of the sheets S is supported by the loading table 308 representing the second supporting member. Since the sheets S are pressed against the belt 301 by pressing plate 310 having a vertical pressing surface, the sheets S are stored in an orderly manner as shown in FIG. 5.

Since plural sheets S are held between belt 301 and belt 304 being overlapped each other to be conveyed and ejected on loading table 308, as described above, a leading edge of succeeding sheet S enters certainly the space between preceding sheet S and belt 301, and sheets S ejected continuously are placed on loading table 308 in parallel. Since a lower edge of the sheets S is supported by the loading table 308, the sheets S are stored on the loading table 308 under the condition that each sheet S is aligned.

The sheet S which has fallen is pressed against belt 301 by pressing plate 310, but the pressing plate 310 presses sheet S with light pressure at a level so that belt 301 can slide on the surface of sheet S without causing any deformation of sheet S, and the pressing plate 310 is urged by constant load springs 311A and 311B to press, thus, the sheet S is pressed by constant pressure that is independent on an amount of sheets S to be stored, and the sheets S are stored under the condition of excellent alignment.

The sheets S conveyed by belt units BUA and BUB and ejected on loading table 308 as stated above are stored to be arranged in the horizontal direction under the condition that their sheet surfaces are perpendicular to the loading table 308.

Based on detection signals from sensor SE that has detected the trailing edge of the rearmost sheet S among sheets S fed to a sheet storing device continuously, controller CR stops motor M1 at the point in time when a certain period of time has elapsed from the detection of the trailing edge, to terminate sheet storing.

The sheet storing device 300 can store sheets S each being different in terms of a length in the conveyance direction.

A length of the sheet in the conveyance direction is fixed according to a size of sheet S and to a type of folding processing as shown in FIGS. 4(*a*), 4(*b*), 4(*c*) and 4(*d*).

Figure 8:
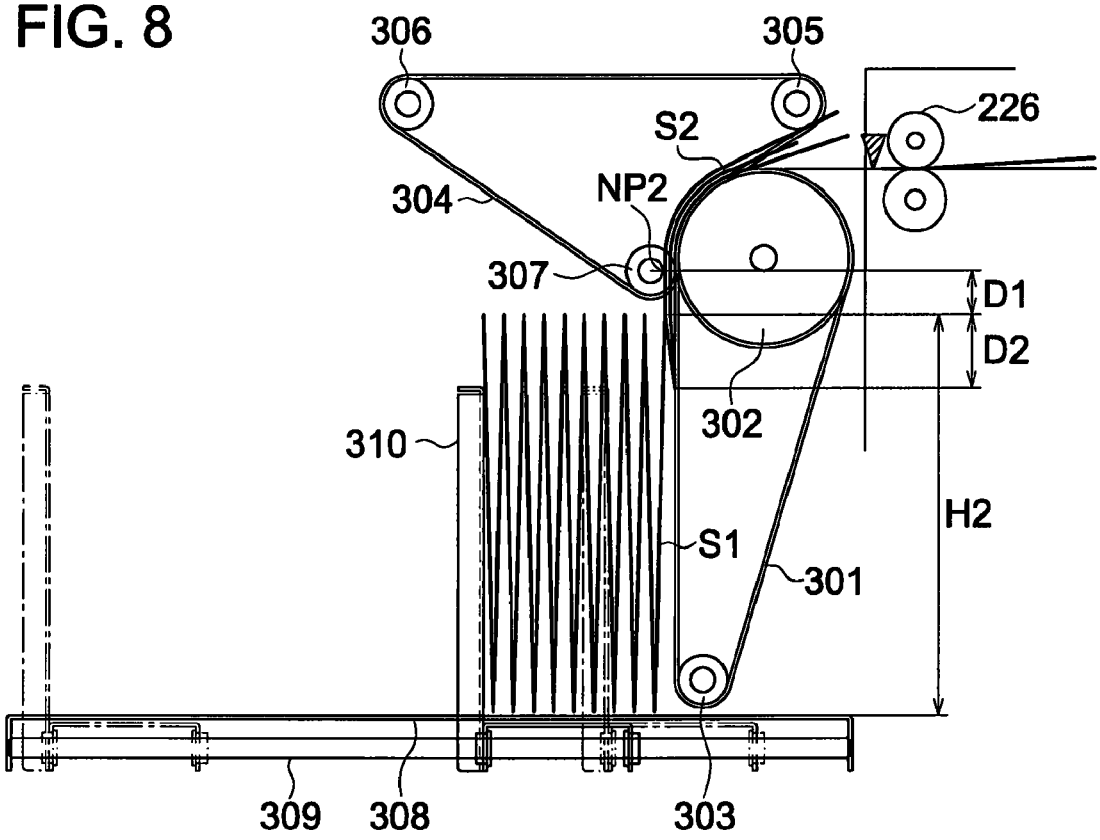
FIG. 8 is a diagram showing a sheet storing device in the case of storing a sheet having a long width.

FIG. 8 is a diagram showing a sheet storing device in the case of storing a sheet whose width H is longer than that shown in FIG. 5.

In FIG. 8, holding lower end position NP2 by small-diameter roller 307 is set to be higher than holding lower end position NP1 in FIG. 5.

Next, holding lower end positions NP1 and NP2 will be described.

Holding lower end position NP2 in FIG. 8 is set to the position that is slightly higher than an upper edge of sheet S that is formed by width H2 of sheet S, in the same way as in the occasion where holding lower end position NP1 in FIG. 5 is set to the position that is slightly higher than an upper edge of sheet S that is formed by width Hi of sheet S as described above.

Due to the setting of this kind, sheet S that is released from holding between belts 301 and 304 falls on loading table 308.

The preferable height for the holding lower end position will be described as follows, referring to an example of holding lower end position NP2 in FIG. 8. Incidentally, the preferable height for the holding lower end position applies to setting of all holding lower end positions including the occasion in FIG. 5.

In FIG. 8, it is assumed that D1 represents a difference between holding lower end position NP2 and height of upper edge H2 of sheet S1, and D2 represents an amount of overlapping between preceding sheet S1 and succeeding sheet S2.

Overlapping between preceding sheet S1 and succeeding sheet S2 will be described by using FIG. 9.

Figure 9:
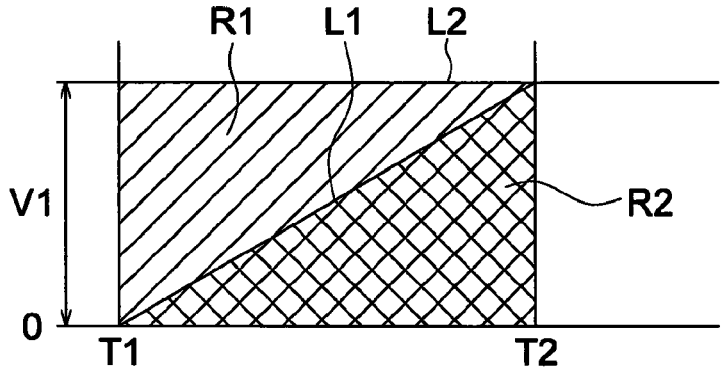
FIG. 9 is a diagram illustrating a difference between a conveyance distance of a large diameter roller and that of a sheet ejection roller.

Large-diameter roller 302 constituting a conveyance device is started at the point in time T1 in FIG. 9 based on leading edge detection signal of sensor SE, and then, is accelerated as shown with straight line L1 to arrive at constant speed V1, and thereafter, rotates at the constant speed to convey sheets that have arrived at the nip portion of belts 301 and 304.

On the other hand, sheet ejection roller 226 of post-processing apparatus 200 rotates at constant speed of conveyance speed V1 as shown with straight line L2 to convey sheets. Therefore, in a range from the point in time T1 to the point in time T2, sheet ejection roller 223 conveys a sheet by a distance shown by a rectangle having area R1 in FIG. 9, while, large-diameter roller 302 conveys a sheet by a distance shown by a triangle having area R2, resulting in generation of a difference between conveyance distance R1 and conveyance distance R2, and an overlap corresponding to this difference is created between preceding sheet S1 and succeeding sheet S2.

Overlap D2 in FIG. 8 is one created in the aforesaid way.

The overlap D2 can be adjusted depending on an extent of acceleration of large-diameter roller 302.

It is preferable that the difference D1 and the overlap D2 satisfy the relationship of D1≦D2.

When this relationship is not satisfied, a clearance is formed between a trailing edge (upper end) of preceding sheet S1 and a leading edge (lower end) of succeeding sheet S2, when a sheet falls after being released from holding between belt 301 and belt 304, and succeeding sheet S2 is not arranged to follow the preceding sheet S1 (right side in FIG. 8) in order, but may be inserted between preceding plural sheets.

By setting the position of small-diameter roller 307 so that the aforesaid conditions may be satisfied, sheet S is placed on loading table 308 in the correct order.

Figure 10:
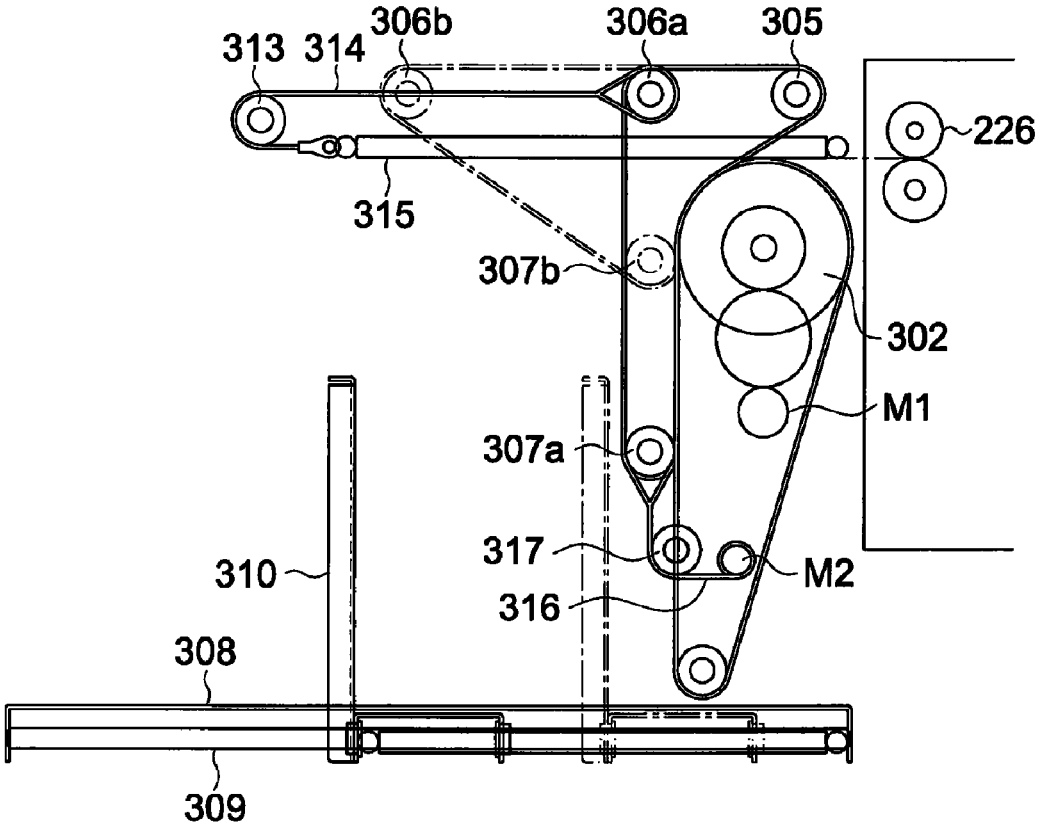
FIG. 10 is a diagram showing a driving system of a sheet storing device.

FIG. 10 is a diagram showing a driving system of sheet storing device 300.

As described above, motor M1 drives large-diameter roller 302 to rotate to convey sheets.

Further, motor M2 drives small-diameter rollers 306 and 307 to displace to conduct switching of holding lower end positions like those from FIG. 5 to FIG. 8.

The small-diameter roller 306 is connected with wire 314 to be driven thereby to move in the horizontal direction. Incidentally, the movement of the small-diameter roller 306 in the horizontal direction is conducted under the guide by an unillustrated guide member.

Further, small-diameter roller 307 is connected with wire 316 to be driven thereby to move vertically. The vertical movement of the small-diameter roller 307 is also guided by an unillustrated guide member.

The wire 314 is wound around wire pulley 313, and the wire 316 is wound around wire pulley 317. Further, the wire 314 is urged by spring 315 which urges the small-diameter rollers 306 and 307 to give tension to belt 304, thus, the belt 304 is stretched constantly under the fixed tension independently of positions of the small-diameter rollers 306 and 307.

Motor M2 rotates in the direction of rolling up wire 316 or in its opposite direction, to move small-diameter roller 306 in the horizontal direction and to move small-diameter roller 307 in the vertical direction.

The holding lower end position is adjusted by vertical movement of the small-diameter roller 307.

Namely, if the small-diameter roller 307 driven by motor M2 is moved from 307*a* to 307*b*, small-diameter roller 306 is moved by urging of spring 315 to the position of 306*b* on the left side. If motor M2 rotates in the opposite direction, small-diameter roller 307 falls to be displaced to 307*a*, while, small-diameter roller 306 is displaced to the position of 306*a* on the right side against urging of spring 315.

Figure 11:
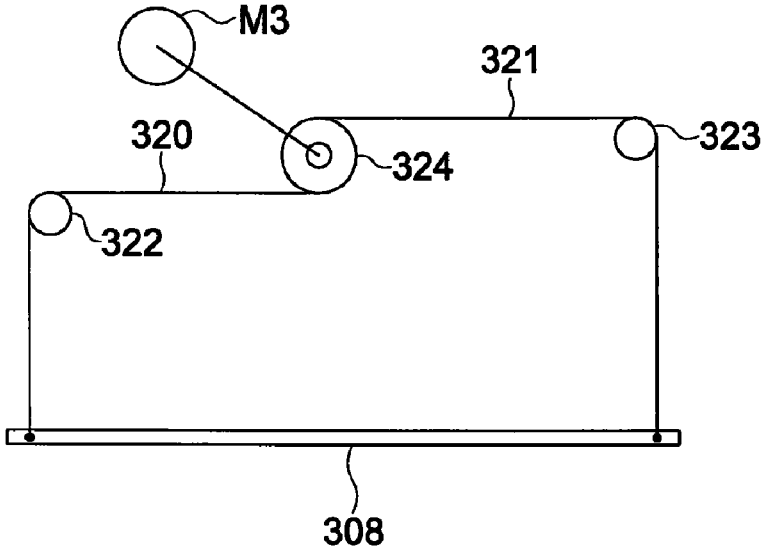
FIG. 11 is a diagram showing another example of a sheet storing device relating to the embodiment of the invention.

FIG. 11 is a diagram showing another example of a sheet storing device relating to the embodiment of the invention. In FIG. 11, a height of an holding lower end position of the conveyance device is changed by changing a height of loading table 308.

In the present example, the position of the small-diameter roller 307 is fixed.

One end of each of wires 320 and 321 is fixed on each of both end portions of loading table 308, and the other end of each of wires 320 and 321 is fixed on drive pulley 324. The loading table 308 is held by wires 320 and 321 through relay pulleys 322 and 323, and the loading table 308 is caused to lower by the clockwise rotation of drive pulley 324, and is caused to rise by counterclockwise rotation.

Motor M3 drives drive pulley 324 to rotate, and the loading table 308 is set to the height corresponding to a sheet size or to a type of folding processing.

What is claimed is:

1. A sheet storing device comprising:

a conveyance device for conveying a sheet while holding the sheet, wherein the conveyance device conveys while holding such that a trailing edge of a preceding sheet and a leading edge of a succeeding sheet have a partial overlap therebetween;

a storing section for storing the sheet in an upright position after the sheet being held by the conveyance device is released at a holding lower end position of the conveyance device; and a controller for controlling the conveyance device to repeat a stop and an acceleration operation for each sheet such that the partial overlap is created and adjusted depending on an extent of an acceleration of the acceleration operation, wherein a distance from the storing section to the holding lower end position of the conveyance device is changeable, and wherein when a difference of a height between an upper edge of the sheet loaded in the upright position on the storing section and the holding lower end position is D1 and when an overlapping length between the preceding sheet and the succeeding sheet is D2, the holding lower end position is set so as to satisfy a relationship D1 ≦D2, and the distance is adjusted so that the preceding sheet has an overlapped portion with the succeeding sheet which is still held by the conveyance device even at a moment when the preceding sheet falls and lands on the storing section after being released at the holding lower end position.

2. The sheet storing device of claim 1, wherein the conveyance device comprises two belt units which have a first conveyance surface for conveying the sheet substantially in a horizontal direction and a second conveyance surface for conveying the sheet downward from the first conveyance surface.

3. The sheet storing device of claim 1, wherein the holding lower end position of the conveyance device is changeable and a change of the holding lower end position changes the distance.

4. The sheet storing device of claim 1, wherein the distance is changed according to at least one of a size of the sheet and a type of folding processing of the sheet.

5. A post-processing unit comprising:

a post-processing apparatus for folding the sheet; and the sheet storing device of claim 1 for conveying and storing the sheet folded by the post-processing apparatus.

6. The sheet storing device of claim 1, wherein the distance is changed by change of a position of a roller of the conveyance device at a lowermost stream side.

7. The sheet storing device of claim 1, wherein the distance is changed by change of a lower end position of a belt unit.

8. The sheet storing device of claim 1, wherein the conveyance device comprises a belt unit in which a belt is stretched between three or more rollers and at least two rollers among the three or more rollers are capable of changing positions thereof.

9. The sheet storing device of claim 1, wherein a belt unit forms a substantially vertical surface and the distance is changed by traveling of a roller along the substantially vertical surface.

10. The sheet storing device of claim 1, wherein the holding lower end position is a position of the conveyance device at a lowermost stream side.

11. The sheet storing device of claim 1, wherein the conveyance device sandwiches the sheet between two belt units.

12. The sheet storing device of claim 11, wherein the two belt units are in contact with each other through contact surfaces thereof and convey the sheet by sandwiching the sheet between the contact surfaces.

13. The sheet storing device of claim 12, wherein the holding lower end position is a lowest position where the contact surfaces are in contact with each other.

14. The sheet storing device of claim 11, wherein a first belt unit among the two belt units forms a substantially vertical surface and the distance is changed by traveling of a lower end portion of a second belt unit among the two belt units along the substantially vertical surface.

15. An image forming system comprising:

an image forming apparatus for forming an image on the sheet;

a post-processing apparatus for folding the sheet ejected from the image forming apparatus; and the sheet storing device of claim 1 for conveying and storing the sheet folded by the post-processing apparatus.

16. A sheet storing device comprising:

a conveyance device for conveying a sheet while holding the sheet, wherein the conveyance device conveys while holding such that a trailing edge of a preceding sheet and a leading edge of a succeeding sheet have a partial overlap therebetween;

a storing section for storing the sheet in an upright position after the sheet being held by the conveyance device is released at a holding lower end position of the conveyance device; and a controller for controlling the conveyance device to repeat a stop and an acceleration operation for each sheet such that the partial overlap is created and adjusted depending on an extent of an acceleration of the acceleration operation, wherein a distance from the storing section to the holding lower end position of the conveyance device is changeable by changing a height of the storing section, and wherein when a difference of a height between an upper edge of the sheet loaded in the upright position on the storing section and the holding lower end position is D1 and when an overlapping length between the preceding sheet and the succeeding sheet is D2, the height of the storing section is set so as to satisfy a relationship D1 ≦D2, and the distance is adjusted so that the preceding sheet has an overlapped portion with the succeeding sheet which is still held by the conveyance device even at a moment when the preceding sheet falls and lands on the storing section after being released at the holding lower end position.

* * * * *